US005248874A

United States Patent [19]

Raverdy

[11] Patent Number: 5,248,874

[45] Date of Patent: Sep. 28, 1993

[54] IMAGE INTENSIFIER TUBE WITH CORRECTION OF BRIGHTNESS AT THE OUTPUT WINDOW

[75] Inventor: Yvan Raverdy, Bas Bernin, France

[73] Assignee: Thomson Tubes Electroniques, Boulogne Billancourt, France

[21] Appl. No.: 941,162

[22] Filed: Sep. 4, 1992

[30] Foreign Application Priority Data

Sep. 20, 1991 [FR] France ..... 91 11608

[51] Int. Cl.[5] ..... H01J 40/14; H01J 40/00

[52] U.S. Cl. ..... 250/214 VT; 313/524

[58] Field of Search ..... 250/213 VT; 313/523-530

[56] References Cited

U.S. PATENT DOCUMENTS

| | | | |
|---|---|---|---|
| 3,443,104 | 5/1969 | Niklas . | |
| 4,062,009 | 12/1977 | Raverdy et al. | 340/324 R |
| 4,069,121 | 1/1978 | Baud et al. | 204/129.3 |
| 4,266,848 | 5/1981 | Schlegel | 313/524 |
| 4,437,035 | 3/1984 | Raverdy et al. | 313/388 |
| 4,740,683 | 4/1988 | Noji et al. | 313/527 |
| 4,755,718 | 7/1988 | Patrick | 313/524 |
| 4,847,482 | 7/1989 | Kubo | 313/525 |
| 5,008,591 | 4/1991 | van der Velden et al. | 313/524 |
| 5,028,842 | 7/1991 | Ricodeau et al. | 313/525 |

FOREIGN PATENT DOCUMENTS 642533 9/1950 United Kingdom .

OTHER PUBLICATIONS

Patent Abstracts of Japan, vol. 11, No. 11 (E-470)(2458), Jan. 13, 1987 & JP-A-61 185 852, Aug. 19, 1986, "Cathode-Ray Tube."

*Primary Examiner*—David C. Nelms
*Assistant Examiner*—Michael Messinger
*Attorney, Agent, or Firm*—Oblon, Spivak, McClelland, Maier & Neustadt

[57] ABSTRACT

An image intensifier tube, having its brightness curve corrected in a simple way. The image intensifier tube comprises an input window (3), and an output window (4) at which the brightness is measured. The output window (4) bears a device for the attenuation of light (20), the opacity of this device being greater in a central zone (0) than it is towards the edges (21).

30 Claims, 2 Drawing Sheets

IMAGE INTENSIFIER TUBE WITH CORRECTION OF BRIGHTNESS AT THE OUTPUT WINDOW

BACKGROUND OF THE INVENTION

1. Field of the Invention

The invention relates to image intensifier tubes, notably of the radiological type. It relates particularly to optical means which can be used to correct the distribution of the luminous intensity at output of the image intensifier tube.

2. Description of the Prior Art

Image intensifier tubes are vacuum tubes comprising an input screen, located at the front of the tube, an electronic optical system and a screen for the observation of the visible image located at the rear of the tube, on the same side as an output window of this tube.

In radiological image intensifier tubes, the input screen further has a scintillator screen which converts the incident X photons into visible photons.

The visible photons excite a photocathode which generates a flux of electrons in response. This flux of electrons is then transmitted by the optical electronic system which focuses the electrons and directs them to the observation screen, more specifically to a cathodoluminescent screen generally constituted by one or more layers of grains of phosphor or luminophore. The cathodoluminescent screen then emits a visible light.

FIG. 1 gives a schematic view of a radiological type of image intensifier tube such as this.

The intensifier tube 1 comprises a glass envelope 2, one end of which, at the front of the tube, is closed by an input window 3 exposed to a radiation of X photons.

The second end of the envelope forming the rear of the tube is closed by an output window 4 transparent to light.

The X rays are converted into light rays by a scintillator screen 5. The light rays excite a photocathode 6 which produces electrons in response. These electrons are extracted from the photocathode 5 and are accelerated towards the output window 4 by means of different electrodes 7, and by an anode 8 positioned along a longitudinal axis 9 of the tube and forming the electronic optical system.

In the example shown, the output window 4 is formed by a transparent glass element attached to the envelope 2 in an imperviously sealed way. In the example shown, this glass element furthermore constitutes a support which bears a cathodoluminescent screen 10, made of luminophores for example.

The impact of the electrons on the cathodoluminescent screen 10 makes it possible to reconstitute an image (amplified in luminance) which, at the outset, was formed on the surface of the photocathode 6. The output window 4, made of glass, forms a part of the envelope 2, in such a way that an external face 13 of this window, opposite the luminophore layer 10, constitutes an external part of the tube 1.

The image displayed on the luminophore layer 10 is visible through the glass element which constitutes the output window 4. Generally, optical sensor devices (not shown) are positioned outside the tube in the vicinity of the output window 4 to pick up this image through the window 4 and enable it to be observed.

The intensifier tube 1 may further comprise, as in the example shown, a transparent strip or plate 14 fixedly joined by a layer of bonder 15 to the external face 13 of the output window 4. The transparent plate 14 has the function of improving the contrast and, to this end, it has a non-negligible thickness E of 10 mm for example. The result thereof is that light rays 16, emitted by the luminophore layer 10, forming substantial angles with a ray normal to the plane of the transparent plate 14, tend to emerge from this plate towards its edges, and thus tend to go out of the field of the optical sensor device (not shown) mentioned here above.

For reasons related notably to electronic optics, the surface of the input screen, namely the surfaces of the input screen 3 as well as of the scintillator and of the photocathode 5, 6 are not plane but bulging. The result thereof is that if the input window 3 is illuminated by a uniform beam of X-rays, the electronic density generated by the input screen is not uniform and this has repercussions, at the output of the tube, on the brightness curve along a diameter D at the output window 4: the brightness curve represents the luminous intensity at each point of the diameter D of the output window 4.

It is observed that this curve is generally shaped like the arc of a circle: the brightness is the maximum towards the center and diminishes appreciably as the edges are approached. The diminishing of brightness at the edges is commonly between 25% and 30% and may attain 35% for intensifier tubes having large-sized input windows.

In the case of radiological image intensifier tubes, it has already been proposed in the prior art (in the European patent document EP 0 239 991) to improve the homogeneity of the brightness by giving a non-homogeneous distribution to the thickness of the layer that constitutes the scintillator 5. This method gives fairly good results, but its implementation on an industrial scale is a delicate and unwieldly affair, notably because the efficiency of a scintillator varies with its thickness.

SUMMARY OF THE INVENTION

One of the aims of the invention is to improve the brightness curve of an image intensifier tube by attenuating the difference between the center and the edges, in a way that is simpler and more compatible with industrial requirements, without downgrading the other characteristics.

In accordance with the invention, the correction of the brightness curve is achieved at the center of the output window, by means of a light attenuator interposed on the path of the light rays emitted by the cathodoluminescent screen towards the exterior of the intensifier tube, and by giving this attenuator a non-uniform opacity that achieves the desired compensation.

Thus, the correction of the brightness curve is done without acting on the scintillator of the primary screen, so that the invention can be applied in a same way to all image intensifier tubes, whether or not they are of the radiological type.

According to the invention, there is proposed an image intensifier tube comprising an output window, a cathodoluminescent screen giving a visible image to the exterior of said intensifier tube through the output window, wherein said image intensifier tube further comprises a light intensity attenuation device positioned so as to be facing the output window and having an opacity to light that is greater before the central zone of the output window than it is towards the edges of this output window.

BRIEF DESCRIPTION OF THE DRAWINGS

Other features and advantages of the invention will appear from the following detailed description, made with reference to the appended drawings, of which.

DETAILED DESCRIPTION OF THE INVENTION

Figure 1:
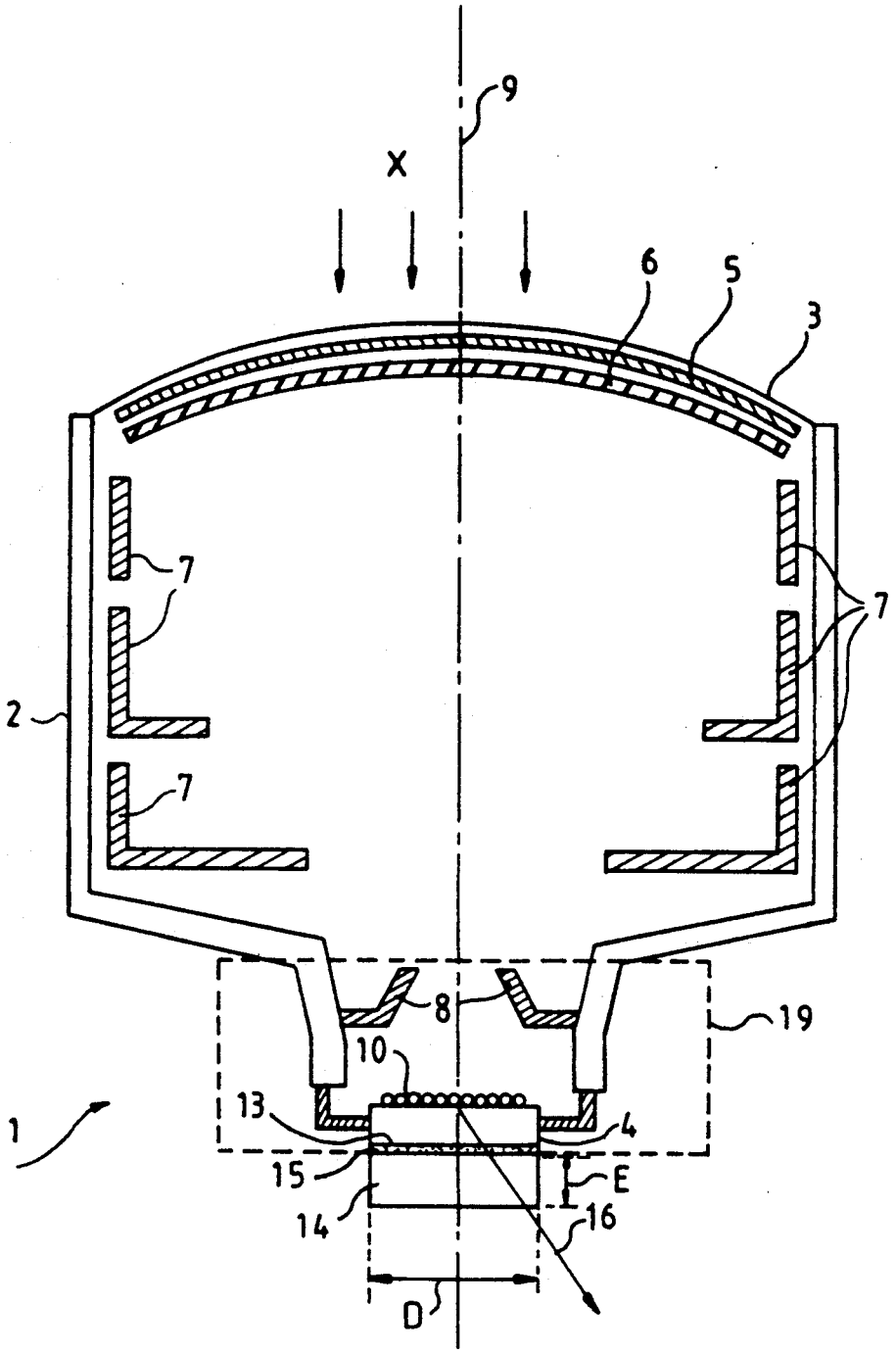
FIG. 1 PRIOR ART
FIG. 1, already described, shows the structure of a prior art radiological image intensifier tube.
Figure 2:
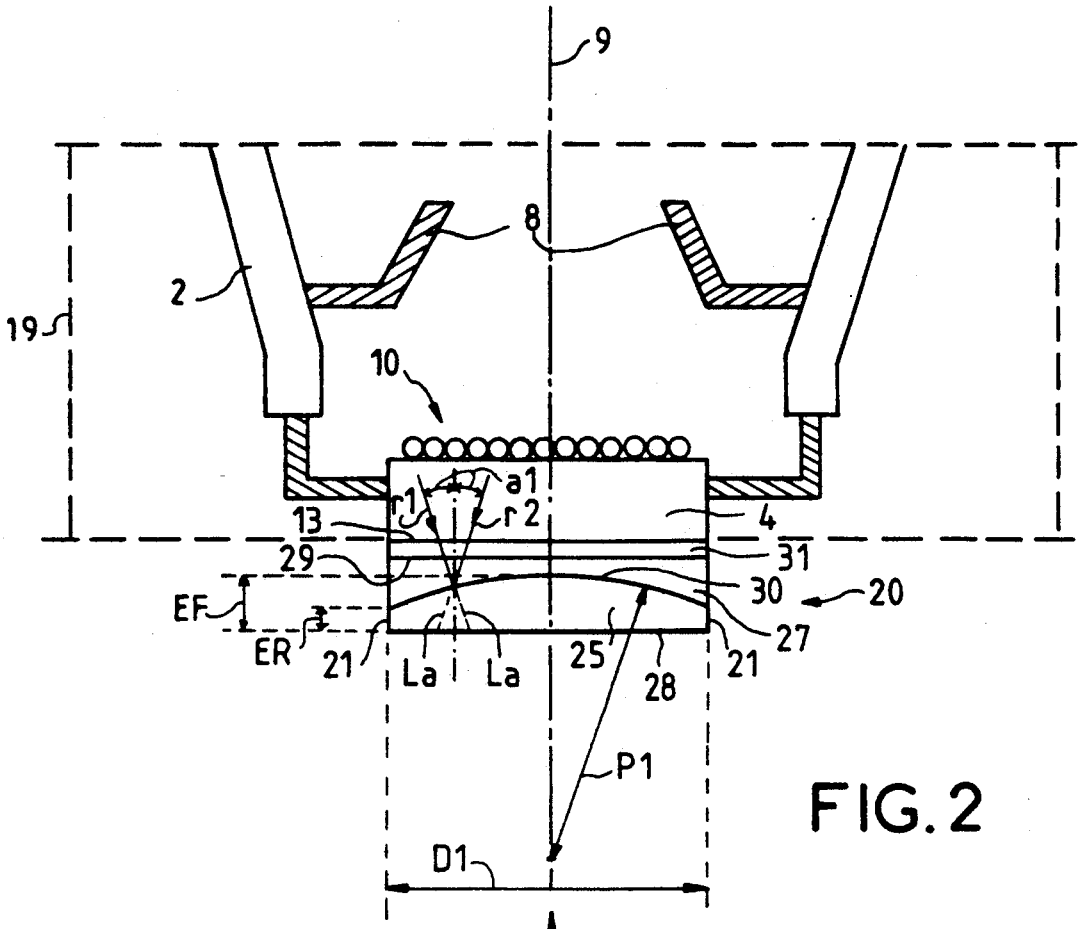
FIG. 2 gives a schematic view of an output window provided with a light attenuator according to the invention.

FIG. 2 is an enlarged view of a box 19 in FIG. 1, and is designed to show, more especially, the output window 4 of an image intensifier tube.

The other parts of this tube, located outside the box, are not modified by the invention and therefore, to simplify the description, they need not be shown. It may be assumed that, in the example, the invention can be applied to an intensifier tube 1 similar to the tube shown in FIG. 1.

The tube 1 has an output window 4 bearing, inside the tube, the cathodoluminescent layer 10, in the same way as in the example of FIG. 1.

According to the invention, the output window 4 bears, on its face 13, opposite the cathodoluminescent screen 10, a light attenuator device 20 having an opacity to light that varies between its edges 21 and its center 0. Since the center 0 is located on the longitudinal axis 9 of the tube, it also corresponds to the center of the output window 4.

According to a preferred exemplary embodiment, the attenuator device has an attenuator element 25 made of a semi-transparent material. The thickness of the attenuator element 25 varies from a large thickness EF in the zone of the center O to a small thickness ER on the edges 21 of this attenuator element. The attenuator element 25 is made, for example, of glass tinted in the mass (with a neutral tone for example). This is a material commonly available in the market with different values of transmission of light that may range, for example, from 50% to 80%.

According to a preferred embodiment, the attenuator element 25 has the general shape of a plano-convex type of lens.

The compensation provided to the brightness curve by the attenuator element 25 is all the greater as the thickness is great at the center O and small at the edges 21. However, for reasons notably of robustness of the device and ease of industrial-scale manufacture, the edges 21 may have a thickness ER that is not negligible in relation to the great thickness EF of the center, as shown in the example of FIG. 2.

Indeed, very promising results have been obtained in conditions that are described in detail here below by way of a non-restrictive example, by using an attenuator element 25 that has the general shape of a plano-convex type of circular lens, and has a profile of the kind illustrated in FIG. 2:

diameter D1 of the attenuator element 25=30 mm;

radius of curvature P1 of the convex part =320 mm;

valve of the greatest thickness EF (at the center O) =0.7 mm;

value of the smallest thickness ER (at the edges 21) =0.4 mm; and by using a glass tinted in the mass, achieving transmission of 70% of the light for a thickness of 0.7 mm.

Figure 3:
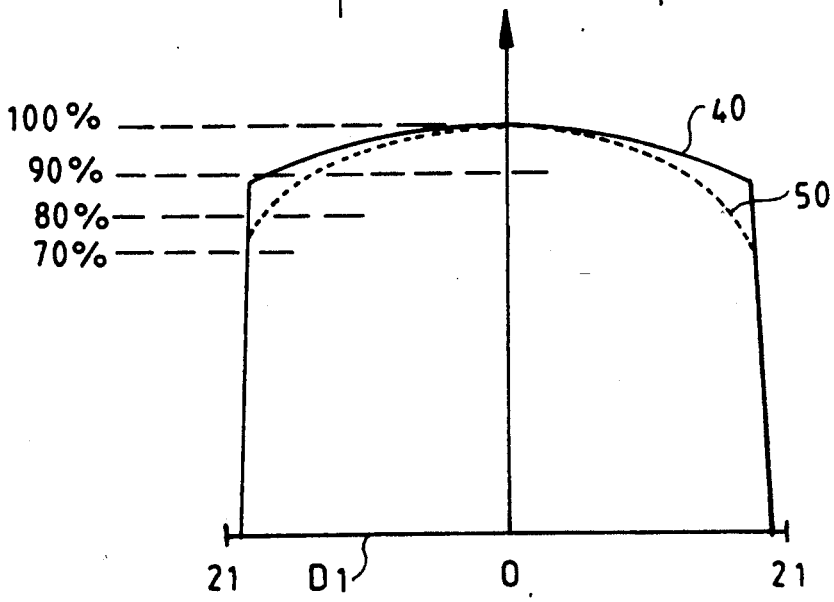
FIG. 3 shows a brightness curve provided with compensation according to the invention.

FIG. 3 shows a brightness curve 40 (in solid lines) obtained at output of an image intensifier tube, along the diameter of the output window 4 and more specifically along the diameter D1 of the attenuator element 25, with the above-mentioned conditions.

The X-axis values are those of the diameter Dl and the Y-axis values are those of the brightness measured, naturally with the attenuator device 25 interposed.

The curve 40 shows a maximum level of brightness towards the center O and a fairly pronounced diminishing towards the edges 21, with a zero value before the edges 21, which shows that the diameter Dl of the attenuator element 25 is slightly greater than the diameter of the useful field at output of the tube 1. The curve has the shape of a flattened arc of a circle towards the center O.

If the value of 100% is given to the maximum brightness displayed in the zone of the center O, it is observed that the difference from this maximum just before the edges 21 is of the order of 10%, which corresponds to an improvement of 10% to 20% as compared with the prior art. Indeed, this must be compared with the difference of almost 30% between the edges and the center, in a curve 50 (shown in dashes) which illustrates the brightness at output of the output window when there is no correction accomplished according to the invention.

Naturally, it is a simple matter to give the attenuating element the attenuation coefficient and the profile that would make it possible to obtain a substantially straight and horizontal curve, or even to achieve overcompensation to take account, in certain cases, of the requirements of the optical sensor devices designed for the observing of the image.

It must be noted however that in practice a certain difference in brightness between the center 0 and the edges 21, as shown by the curve 40, may be desirable.

Referring again to FIG. 2, in the non-restrictive example shown, the attenuation device constitutes an optical doublet with parallel faces 28, 29. It is constituted by two complementary parts 25, 27, the first one of which is the attenuator element 25, with the shape of a plano-convex lens, and the second one of which is complementary to the first one (i.e. with a plano-concave shape) and constitutes the cradle 27 for the convex element 30 of the attenuator element 25. Naturally, the cradle 27 is transparent to light. The two faces 28, 29 are parallel to each other and are parallel to the planes of the output window 4 and of the cathodoluminescent screen 10.

The advantage of an optical doublet such as this is that it can be manufactured industrially independently of the tube 1, and then attached to this tube 1 by being fixed to the output window 4, simply by means of a layer of bonder 31 for example.

The attenuator element 25 can also be fixed directly to the output window 4, by bonding for example.

It must be noted, however, that the simplest and most natural way of fixing the attenuator element 25 to the output window is not the most appropriate one. Indeed, the simplest way of fixing the attenuator element 25 to the window 4 consists in placing it on the window 4 with the plane face 28 of this attenuator element 25 supported on the output window, i.e. oriented towards the cathodoluminescent screen 10.

However, it is recommended, on the contrary, to fix the attenuator element 4 with the reverse orientation, i.e. with its convex part 30 oriented towards the output window 4 and hence towards the cathodoluminescent screen 10, for reasons explained here below, this being the case both when the attenuator element 25 is mounted directly in an optical doublet and when it is mounted directly on the output window 4. Naturally, in the latter case, the space occupied by the cradle 27 shown in FIG. 2 is filled with bonder. Bonders that are transparent to light and have various indices of refraction are commonly available in the market: they can therefore be chosen with refraction indices very close to those of the transparent materials used.

The attenuator element 25 corrects the brightness curve at output of the tube in one and the same way for either of the two possible orientations described here above. But the presence of the attenuator element 25 contributes an additional advantageous effect which is seen in a great improvement of the contrast. This improvement of the contrast results from the fact that, by mounting an element on the output window 4 that reduces the transmission of light, the rays parallel to the normal to the plane of the output window, namely the rays parallel to the longitudinal axis 9, are attenuated to a lesser degree, and the inclined rays are attenuated to a greater degree because they cross a greater absorbent length; and the inclined rays are the ones that lower the quality of the contrast.

If the attenuator element is mounted with its convex part 30 oriented towards the output window 4, as shown in FIG. 2 and as recommended, the attenuation due to the absorbent length crossed $L_a$ (in the attenuator element) is the same for the rays r1, r2 inclined by a same angle value al and penetrating the attenuator element 25 at a same point B, out with different directions.

By contrast, if the attenuator element 25 is mounted with the reverse orientation (not shown), i.e. with its plane face 28 supported on the output window 4, for inclined rays such as r1, r2, penetrating the attenuator 25 at a same point of its plane face 28, the absorbent lengths are different, thus leading to the achieving of a variable attenuation of the inclined rays as a function of their direction.

The correction of the brightness curve in accordance with the invention can be applied substantially in a same way to all types of image intensifier tubes, with or without scintillator screens, owing to the fact that the attenuator element 25 which makes this correction can be mounted outside the intensifier tube. Consequently, another important advantage is that the intensifier tube and the attenuator element 25 can be built independently of each other. An already mounted attenuator element 25 can thus be replaced, if necessary, by another one making a different correction, this being achieved without damage for the intensifier tube.

What is claimed is:

1. An image intensifier tube comprising an output window, a cathodoluminescent screen giving a visible image to the exterior of said intensifier tube through the output window, wherein said image intensifier tube further comprises a light intensity attenuation device positioned so as to be facing the output window and having an opacity to light that is greater before the central zone of the output window than the opacity to light towards the edges of the output window.

2. An intensifier tube according to claim 1, wherein the attenuation device comprises an attenuator element having an opacity to light that increases with the thickness thereof.

3. An intensifier tube according to claim 2, wherein the attenuator element has a thickness which is greater at a center portion that towards the edges thereof.

4. An intensifier tube according to claim 3, wherein the attenuator element has the general shape of a plano-convex lens.

5. An intensifier tube according to claim 2, wherein the attenuator element has a plane face and wherein the thickness of the attenuator element varies with respect to said plane face.

6. An intensifier tube according to claim 5, wherein said plane face of the attenuator element is oriented in a direction opposite to the cathodoluminescent screen.

7. An intensifier tube according to claim 1, wherein the attenuator device is fixed to the output window at the exterior of said intensifier tube.

8. An intensifier tube according to claim 2, wherein the attenuator element is fixed by bonding to the output window.

9. An intensifier tube according to claim 2, further comprising:

a complementary attenuator element which is complementary to the attenuator device, the complementary attenuator element being transparent to light, the shape of said complementary attenuator element is complementary to that of the attenuator element in order to constitute, with said complementary attenuator element, an optical doublet with parallel faces.

10. An intensifier tube according to any of the above claims, further comprising:

an electron emission means, optimized to a frequency of X-rays, for emitting electrons onto said cathodoluminescent screen so that said cathodoluminescent screen emits an image corresponding to X-rays directed towards said electron emission means.

11. An image intensifier tube comprising:

an output window;

a cathodoluminescent screen giving a visible image to the exterior of said intensifier tube through the output window;

a light intensity attenuation lens positioned so as to be facing the output window sand having an opacity to light that is greater before a central portion of the output window than the opacity to light towards the edges of the output window.

12. An intensifier tube according to claim 11, wherein the attenuation lens has an opacity to light that increases with the thickness thereof.

13. An intensifier tube according to claim 12, wherein the attenuation lens has a thickness which is greater at a center portion than towards the edges thereof.

14. An intensifier tube according to claim 13, wherein the attenuation lens has the general shape of a plano-convex lens.

15. An intensifier tube according to claim 12, wherein the attenuation lens has a plane face and wherein the thickness of the lens varies with respect to said plane face.

16. An intensifier tube according to claim 15, wherein said plane face of the attenuation lens is oriented in a direction opposite to the cathodoluminescent screen.

17. An intensifier tube according to claim 11, wherein the attenuation lens is fixed to the output window at the exterior of said intensifier tube.

18. An intensifier tube according to claim 12, wherein the attenuation lens is fixed by bonding to the output window.

19. An intensifier tube according to claim 12, further comprising:

a complementary attenuator element which is complementary oriented to the attenuation lens, the complementary attenuator element being substantially transparent to light, the shape of said complementary attenuator element being complementary to the shape of the attenuation lens in order to constitute an optical doublet with parallel faces.

20. An intensifier tube according to any of the above claims, further comprising:

an electron emission means, optimized to a frequency of X-rays, for emitting electrons onto said cathodoluminescent screen so that said cathodoluminescent screen emits an image corresponding to X-rays directed toward said electron emission means.

21. An image intensifier tube, comprising:

a curved electron emission means for emitting electrons in response to energy directed thereon, said density of said emitted electrons being non-uniform when uniform energy is directed on the curved electron emission means because of a curvature of the curved electron emission means;

a cathode luminescent screen means for emitting a visible light image through an output window in response to said electron emitted by said curved emission means, said visible light image being brighter at a center portion than an outer portion because of the curvature of the curved electron emission means; and a light intensity attenuation means facing the output window and having an opacity to light that is greater at a central portion of the output window than at an outer portion of the output window.

22. An image intensifier tube according to claim 21, wherein the light intensity attenuation means comprises an attenuator element having a opacity to light that increases with the thickness thereof.

23. An image intensifier tube according to claim 22, wherein the attenuator element has a thickness which is greater at its center than towards the edges thereof.

24. An image intensifier tube according to claim 23, wherein the attenuator element has the general shape of a plano-convex lens.

25. An image intensifier tube according to claim 22, wherein the attenuator element has a plane face and wherein the thickness of the attenuator element various with respect to said plane face.

26. An image intensifier tube according to claim 215, wherein said plane face of the attenuator element is oriented in a direction opposite to the cathode luminescent screen means.

27. An image intensifier tube according to claim 21, wherein the light intensity attenuation means is fixed to the output window at the exterior of said image intensifier tube.

28. An image intensifier tube according to claim 22, wherein the attenuator element is fixed by bonding to the output window.

29. An image intensifier tube according to claim 22, wherein the light intensity attenuation means further comprises:

a light transparent element, having a shape which is complementary to that of the attenuator element in order to constitute with said clear element, an optical doublet with parallel faces.

30. An intensifier tube according to claim 21, wherein the electron emission means is optimized to a frequency of X-rays.

* * * * *